US006433473B1

(12) United States Patent
Chakravorty et al.

(10) Patent No.: US 6,433,473 B1
(45) **Date of Patent: *Aug. 13, 2002**

(54) ROW ELECTRODE ANODIZATION

(75) Inventors: Kishore K. Chakravorty, San Jose; Fariborz Nadi, Albany; Christopher J. Spindt, Menlo Park; Ronald L. Hansen; Colin D. Stanners, both of San Jose, all of CA (US)

(73) Assignee: Candescent Intellectual Property Services, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/258,021

(22) Filed: Feb. 25, 1999

Related U.S. Application Data

(63) Continuation-in-part of application No. 09/183,540, filed on Oct. 29, 1998, now Pat. No. 5,942,841.

(51) Int. Cl.[7] ..... H01J 1/62; H01J 63/04; H01J 9/00; H01J 9/24

(52) U.S. Cl. ..... 313/495; 313/309; 313/336; 313/351; 445/24; 445/50; 445/51

(58) Field of Search ..... 313/309, 311, 313/336, 351, 495; 445/24, 50, 51; 205/124, 324–25, 121

(56) References Cited

U.S. PATENT DOCUMENTS

| | | | | | |
|---|---|---|---|---|---|
| 5,170,092 | A | | 12/1992 | Tomii et al. | 313/310 |
| 5,194,136 | A | | 3/1993 | Jeung et al. | 205/122 |
| 5,243,252 | A | | 9/1993 | Kaneko et al. | 313/309 |
| 5,359,261 | A | | 10/1994 | Kondo et al. | 313/509 |
| 5,397,957 | A | | 3/1995 | Zimmerman | 313/309 |
| 5,591,352 | A | | 1/1997 | Peng | 216/11 |
| 5,614,781 | A | * | 3/1997 | Spindt et al. | 313/422 |
| 5,619,097 | A | * | 4/1997 | Jones | 313/495 |
| 5,643,817 | A | | 7/1997 | Kim et al. | 437/51 |
| 5,675,212 | A | * | 10/1997 | Schmid et al. | 313/495 X |
| 5,785,838 | A | | 7/1998 | Sugimura et al. | 205/83 |
| 5,811,326 | A | | 9/1998 | Yamamoto | 438/163 |
| 5,818,070 | A | | 10/1998 | Yamazaki et al. | 257/72 |
| 5,821,911 | A | * | 10/1998 | Jachimowicz | 345/7 |
| 5,844,824 | A | * | 12/1998 | Newman et al. | 364/708.1 |
| 5,849,604 | A | | 12/1998 | Sugawara et al. | 438/30 |
| 5,867,795 | A | * | 2/1999 | Novis et al. | 455/566 |
| 5,872,424 | A | * | 2/1999 | Spindt et al. | 313/495 |
| 5,894,188 | A | * | 4/1999 | Chakvorty et al. | 313/309 |
| 5,942,841 | A | * | 8/1999 | Chakravorty | 313/309 |
| 5,945,972 | A | * | 8/1999 | Okumura et al. | 345/98 |
| 5,956,611 | A | * | 9/1999 | Cathey, Jr. et al. | 438/630 |
| 6,149,792 | A | * | 11/2000 | Chakravorty | 205/124 |
| 6,225,732 | B1 | * | 5/2001 | Chakvorty et al. | 313/309 |

* cited by examiner

*Primary Examiner*—Vip Patel
*Assistant Examiner*—Mack Haynes
(74) *Attorney, Agent, or Firm*—Wagner Murabito & Hao LLP

(57) ABSTRACT

A structure and method for forming an column electrode for a field emission display device wherein the column electrode is disposed beneath the field emitters and the row electrode. In one embodiment, the present invention comprises depositing a resistor layer over portions of a column electrode. Next, an inter-metal dielectric layer is deposited over the column electrode. In the present embodiment, the inter-metal dielectric layer is deposited over portions of the resistor layer and over pad areas of the column electrode. After the deposition of the inter-metal dielectric layer, the column electrode is subjected to an anodization process such that exposed regions of the column electrode are anodized. In so doing, the present invention provides a column electrode structure which is resistant to column to row electrode shorts and which is protected from subsequent processing steps.

37 Claims, 15 Drawing Sheets

ROW ELECTRODE ANODIZATION

This Application is a Continuation-in-Part of commonly-owned U.S. patent application Ser. No. 09/183,540 filed Oct. 29, 1998, now U.S. Pat. No. 5,942,841, and entitled ROW ELECTRODE ANODIZATION.

FIELD OF THE INVENTION

The present claimed invention relates to the field of flat panel displays. More particularly, the present claimed invention relates to the formation of a row electrode for a flat panel display screen structure.

BACKGROUND ART

Field emission display devices are typically comprised of numerous layers. The layers are formed or deposited using various fabrication process steps. Prior Art FIG. 1A is a schematic side sectional view of a portion of a pristine conventional field emission display structure. More specifically, Prior Art FIG. 1A illustrates an emitter electrode layer 100 having an overlying resistive layer 102 and an overlying inter-metal dielectric layer 104. Field emitter structures, typically shown as 106*a* and 106*b*, are shown disposed within cavities formed into inter-metal dielectric layer 104. A gate electrode 108 is shown disposed above inter-metal dielectric layer 104. As mentioned above, Prior Art FIG. 1 schematically illustrates a portion of a pristine conventional field emission display structure. However, conventional field emission display structures are typically not pristine. That is, manufacturing and fabrication process variations often result in the formation of a field emission display structure containing significant defects.

With reference next to Prior Art FIG. 1B, a side sectional view of a portion of a defect-containing field emission display structure is shown. During the fabrication of conventional field emission display structures, the aforementioned layers are often subjected to caustic or otherwise deleterious substances. Specifically, during the fabrication of various overlying layers, emitter electrode layer 100 is often subjected to processes which adversely affect the integrity of emitter electrode 100. As shown in the embodiment of Prior Art FIG. 1B, certain fabrication process steps can deleteriously etch or corrode emitter electrode 100. In fact, some conventional fabrication processes can result in the complete removal of at least portions of emitter electrode 100. Such degradation of emitter electrode 100 can render the field emission display device defective and even inoperative.

With reference next to Prior Art FIG. 1C, a side sectional view of a portion of another defect containing field emission display structure is shown. In addition to unwanted corrosion or etching of the emitter electrode, other defects can occur which degrade or render the field emission display structure inoperable. In the embodiment of Prior Art FIG. 1C, feature 110 represents a "short" extending between emitter electrode 100 and gate electrode 108. Such shorting can occur in a conventional field emission display device when the emitter electrode is not properly insulated from the gate electrode. That is, if a region on the conductive surface of the emitter electrode is exposed and, therefore, not properly insulated from the gate electrode, shorting to the gate electrode can occur. Portions of the emitter electrode may remain exposed when deposition of various layers over the emitter electrode is not consistent or complete, or when the layers are degraded (e.g. etched or corroded) by subsequent process steps. The inconsistent deposition or degradation of the layers between the emitter electrode and the gate electrode can result in the existence of non-insulative paths which extend from the emitter electrode to the gate electrode. Such a short can render the field emission display device defective and even inoperative. All of the above-described defects result in decreased field emission display device reliability and yield.

Referring now to Prior Art FIG. 1D, a simplified schematic top plan view of emitter electrode and gate electrode orientation is shown. As shown in Prior Art FIG. 1D, emitter electrodes 150, 152, 154, and 156 are typically the display row electrodes and are conventionally disposed underlying gate electrodes 158, 160, and 162 which are typically display column electrodes. Only a few emitter and column electrodes are shown in Prior Art FIG. 1D for purposes of clarity. It will be understood, however, that in a conventional field emission display device numerous additional emitter and column electrodes will be present.

Referring still to Prior Art FIG. 1D, during typical operation, one of row electrodes 150, 152, 154, and 156 will have a current driven therethrough. A desired one of column electrodes 158, 160, and 162 has an electrical potential applied with respect to the row electrodes such that the subpixel located at the intersection of the activated column and emitter electrode emits electrons. It will be understood that in conventional field emission display devices each subpixel has a corresponding intersection of an emitter and a column. For example, when emitter electrode 150 has current passed therethrough and column electrode 158 has a potential applied thereto, the subpixel corresponding to the intersection of emitter electrode 150 and column electrode 158 will emit electrons. Additionally, in conventional field emission display devices, subpixels are oriented in rows across the display. Therefore, when current is passed through a row electrode each and every subpixel in that row is activated (the subpixel emits electrons only when the corresponding column electrode has the said electrical potential applied thereto). Thus, the current in the row electrode must supply all the subpixels in that row. For purposes of the present discussion it will be assumed that the current is driven through row electrodes 150, 152, 154, and 156 by drivers 164, 166, 168, and 170, respectively. That is, in the representation of Prior Art FIG. 1D, the current is passed through row electrodes 150, 152, 154, and 156 from left to right. As a result of activating each and every subpixel in the row (i.e. sharing the row electrode current between all of the subpixels), a subpixel corresponding to, for example, the intersection of row electrode 150 and column 158 will be more brightly illuminated than the subpixel corresponding to, for example, the intersection of row electrode 150 and column 160 due to the voltage drop along the row caused by the emitter current drain from each activated subpixel. This decrease or "drop-off" in the brightness of subpixels adversely affects the characteristics of a field emission display device.

Furthermore, the emitter electrodes must also be protected from degradation during subsequent processing. The emitter electrodes must also be manufactured and utilized in a manner which reduces shorts occurring between the emitter electrode and the gate electrode.

Thus, a need exists for a field emission display device wherein display characteristics such as display brightness are not degraded by current drain across the length of the row electrode. Still another a need exists for a field emission display structure which is less susceptible to emitter electrode degradation. A further need exists for a gate electrode structure and gate electrode formation method for use in a field emission display device wherein the gate electrode reduces the occurrence of gate to emitter shorts.

SUMMARY OF INVENTION

The present invention provides a field emission display device wherein display characteristics such as display brightness are not degraded by current drain across the length of the row electrode. The present invention further provides a field emission display structure which is less susceptible to emitter electrode degradation. The present invention also provides a gate electrode structure and gate electrode formation method for use in a field emission display device wherein the gate electrode reduces the occurrence of gate to emitter shorts.

Specifically, in one embodiment, the present invention provides a structure and method for forming a column (sometimes referred to as "row") electrode for a field emission display device wherein the column (or row) electrode is disposed beneath the field emitters and the row (or column) electrode. In one embodiment, the present invention comprises depositing a resistor layer over portions of a column (or row) electrode. Next, an inter-metal dielectric layer is deposited over the column (or row) electrode. In the present embodiment, the inter-metal dielectric layer is deposited over portions of the resistor layer and over pad areas of the column (or row) electrode. After the deposition of the inter-metal dielectric layer, the column (or row) electrode is subjected to an anodization process such that exposed regions of the column (or row) electrode are anodized. In so doing, the present invention provides a column (or row) electrode structure which is resistant to gate to emitter shorts and which is protected from subsequent processing steps.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrates embodiments of the invention and, together with the description, serve to explain the principles of the invention.

Prior Art

Prior Art

Prior Art

Prior Art

The drawings referred to in this description should be understood as not being drawn to scale except if specifically noted.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 2:
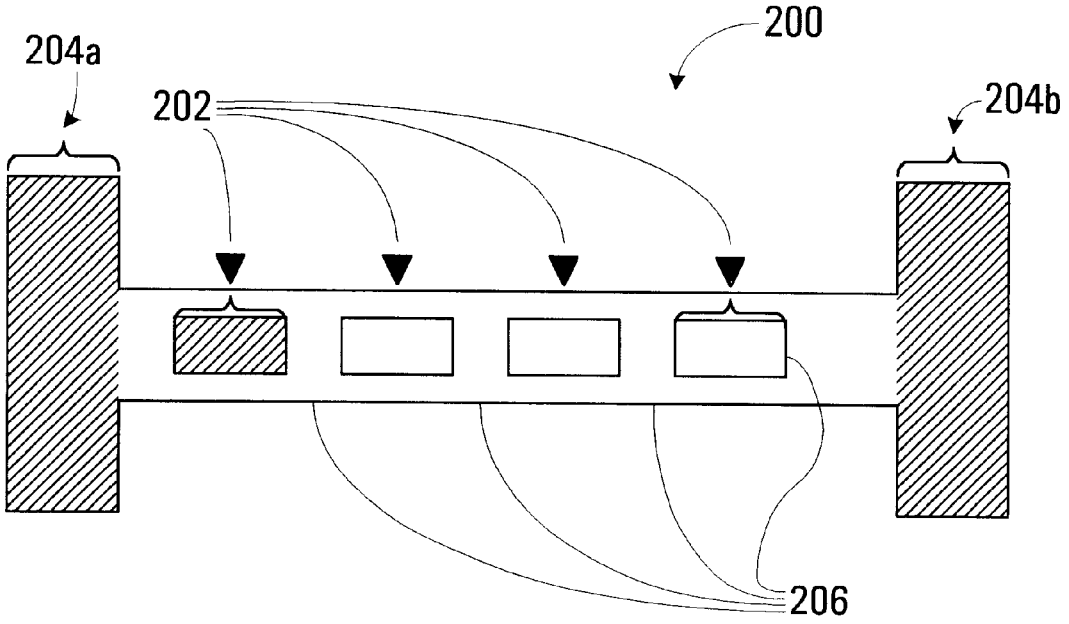
FIG. 2 is a top plan view of a selectively masked emitter electrode in accordance with the present claimed invention.

With reference now to FIG. 2, a top plan view of a masked emitter electrode 200 is shown in accordance with the present claimed invention. In the present embodiment, the emitter electrode is formed by depositing a conductive layer of material and patterning the conductive layer of material to form emitter electrode 200. In the present embodiment, emitter electrode 200 is formed of aluminum. The present invention is also well suited however, to use with a emitter electrode which is comprised of more than one type of conductive material. For example, in another embodiment of the present invention, emitter electrode 200 is comprised of aluminum having a top surface clad with tantalum. In yet another embodiment of the present invention, emitter electrode 200 is comprised of aluminum having a top surface and side surfaces clad with tantalum. Although such an emitter electrode formation method is described in conjunction with the present embodiment, the present invention is well suited to use with emitter electrodes formed using various other emitter electrode formation techniques or methods. In the following discussion, only a single emitter electrode 200 is shown and described for purposes of clarity. It will be understood, however, that the present invention is well suited to implementation with an array of such emitter electrodes. The emitter electrode can be either a row or a column electrode.

With reference still to FIG. 2, in the present embodiment, emitter electrode 200 is selectively masked such that first regions 202, 204*a*, and 204*b* of emitter electrode 200 are masked, and such that second regions 206 of emitter electrode 200 are not masked. More specifically, in the present invention, the first masked regions are those surface areas of emitter electrode 200 which need to be conductive. For example, in the present embodiment, masked regions 202 are sub-pixel areas of emitter electrode 200. That is, masked regions 202 correspond to locations on emitter electrode 200 which will be aligned with sub-pixel regions on the faceplate of the field emission display structure. Additionally, in this embodiment, masked regions 204*a* and 204*b* are pad areas of emitter electrode 200. The pad areas are used to couple emitter electrode 200 to a current source. The second unmasked regions 206 are those surface areas of emitter electrode 200 which do not need to be conductive for the field emission display device to function properly. In the present embodiment, the unmasked regions 206 are comprised of all of the exposed surfaces of emitter electrode 200 which are neither sub-pixel areas nor pad areas. With reference still to FIG. 2, in the present embodiment, the selective masking of emitter electrode 200 is accomplished using an anodization photo mask. It will be understood, however, that selective masking of emitter electrode 200 can be accomplished using various other mask types and masking methods.

Figure 3:
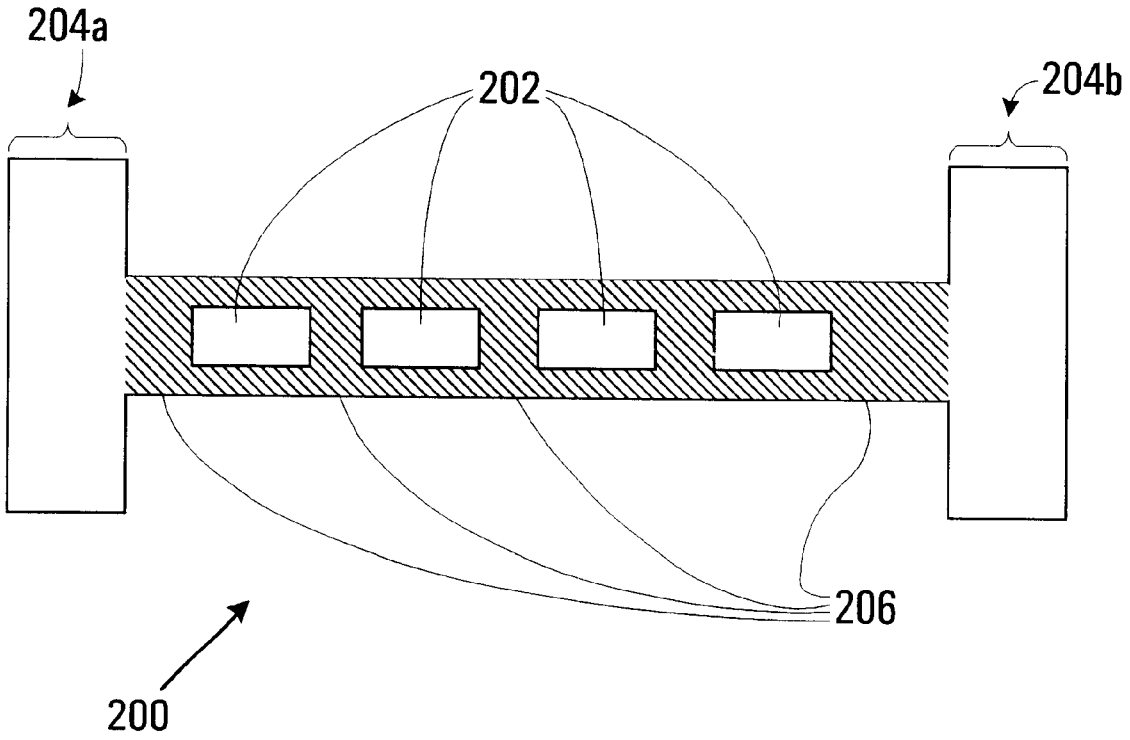
FIG. 3 is a top plan view of an emitter electrode which has been selectively anodized in accordance with the present claimed invention.

Referring next to FIG. 3, a top plan view of emitter electrode 200 of FIG. 2 is shown after subjecting emitter electrode to an anodization process in accordance with the present claimed invention. In the present invention, selectively masked emitter electrode 200 is subjected to an anodization process using, for example, a citric acid solution to accomplish the anodization process. In so doing, emitter electrode 200 is thereby anodized at the unmasked regions 206, and is not anodized at regions 202, 204*a*, and 204*b*. Thus, those surface areas of emitter electrode 200 which need to be conductive (e.g. sub-pixel and pad areas) are not anodized, and those surface areas of emitter electrode 200 which do not need to be conductive (e.g. areas other than sub-pixel and pad areas) are anodized. By selectively anodizing emitter electrode 200, the present invention provides an emitter electrode structure 200 which is less susceptible to damage during subsequent process steps utilized during the fabrication of the field emission display device. Thus, large portions (i.e. anodized areas 206 of emitter electrode 200) are protectively coated and thereby guarded from harmful agents which could otherwise etch/corrode emitter electrode 200 during subsequent fabrication of a field emitter display device.

As yet another benefit, because the surface of emitter electrode 200 is not highly conductive at anodized portions 206, electron emission from these areas is highly reduced. As a result, emitter to column shorts are minimized by the present anodization invention. By reducing such emitter to column shorts, the present invention provides an emitter electrode and an emitter electrode formation method, which improves reliability and yield.

Figure 4:
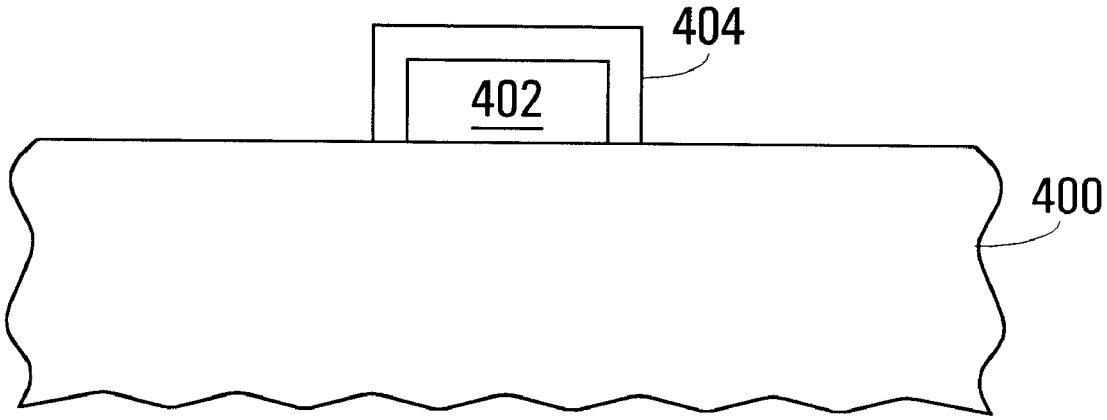
FIG. 4 is a side sectional view of an anodized emitter electrode in accordance with the present claimed invention.

With reference next to FIG. 4, a side sectional view of an emitter electrode anodized in accordance with the present invention is shown. In the embodiment of FIG. 4, a substrate 400 has an emitter electrode 402 formed thereon. In this embodiment, emitter electrode 402 is comprised of a conductive material such as, for example, aluminum. The present embodiment subjects aluminum emitter electrode 402 to an anodization process using, for example, a citric acid solution to accomplish the anodization process. In so doing, aluminum emitter electrode 402 is coated by a layer of $Al_2O_3$ 404. Although $Al_2O_3$ is specifically mentioned in the present embodiment, the present invention is well suited to the use of various other stoichiometries. That is, the present invention is well suited to forming an anodized coating comprised of $Al_xO_y$.

Figure 5:
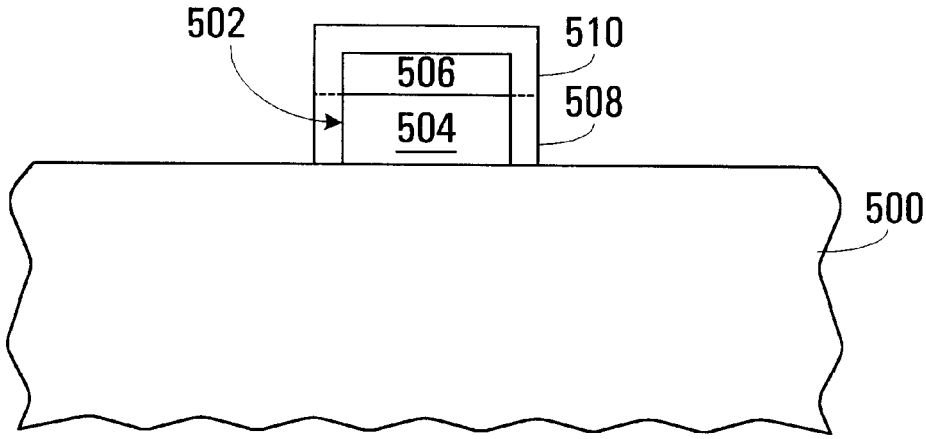
FIG. 5 is a side sectional view of a tantalum-clad anodized emitter electrode in accordance with the present claimed invention.

With reference next to FIG. 5, a side sectional view of another embodiment of an emitter electrode anodized in accordance with the present invention is shown. In the embodiment of FIG. 5, a substrate 500 has an emitter electrode 502 formed thereon. In this embodiment, emitter electrode 502 is comprised of a conductive material such as, for example, aluminum, having a top surface 506 clad with another conductive material such as, for example, tantalum. The present embodiment subjects tantalum-clad aluminum emitter electrode 502 to an anodization process using, for example, a citric acid solution to accomplish the anodization process. In so doing, the exposed aluminum portions of emitter electrode 502 (e.g. the lower side portions of emitter electrode 502) are coated by a layer of $Al_2O_3$ 508. After the anodization process of the present invention, the tantalum-clad portions of emitter electrode 502 (e.g. the top surface 506 of emitter electrode 502) are coated with $Ta_2O_5$ 510. As mentioned previously, emitter electrode 502 is subjected to the above-described anodization process at those surface areas of emitter electrode 502 which do not need to be conductive (e.g. areas other than sub-pixel and pad areas). Additionally, in this embodiment of the present invention, in which the emitter electrode has exposed regions of both aluminum and tantalum, anodization of the aluminum and the tantalum is achieved concurrently.

Figure 6:
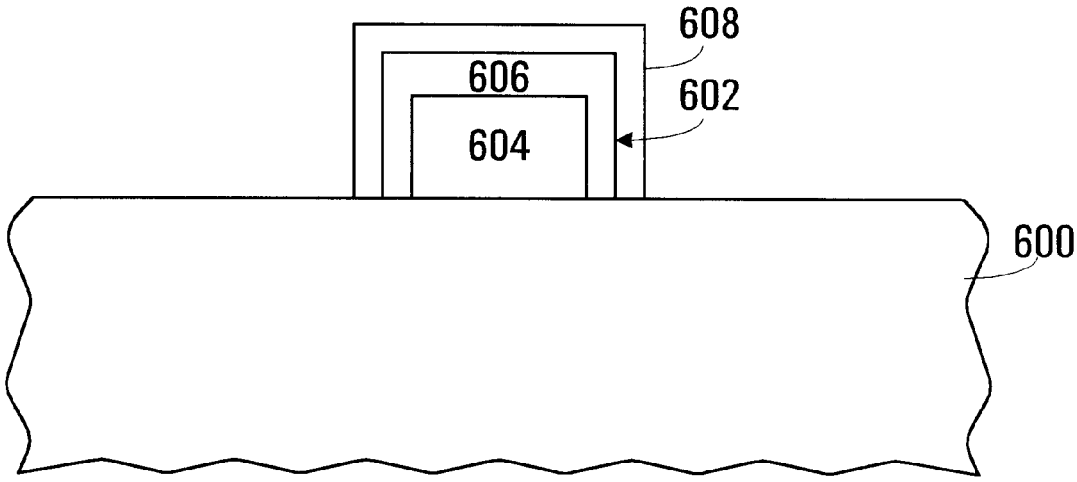
FIG. 6 is a side sectional view of a tantalum-coated anodized emitter electrode in accordance with the present claimed invention.

With reference next to FIG. 6, a side sectional view of yet another embodiment of an emitter electrode anodized in accordance with the present invention is shown. In the embodiment of FIG. 6, a substrate 600 has an emitter electrode 602 formed thereon. In this embodiment, emitter electrode 602 is comprised of a conductive material such as, for example, aluminum 604, completely covered with another conductive material such as, for example, tantalum 606. The present embodiment subjects the tantalum-covered aluminum emitter electrode 602 to an anodization process using, for example, a citric acid solution to accomplish the anodization process. In so doing, tantalum-covered emitter electrode 602 is coated with $Ta_2O_5$ 608. Although $Ta_2O_5$ is specifically mentioned in the present embodiment, the present invention is well suited to the use of various other stoichiometries. That is, the present invention is well suited to forming an anodized coating comprised of $Ta_xO_y$. As mentioned previously, tantalum-covered emitter electrode 602 is subjected to the above-described anodization process at those surface areas of tantalum-covered emitter electrode 602 which do not need to be conductive (e.g. areas other than sub-pixel and pad areas). The present embodiment also includes a substantial benefit. Specifically, in such an embodiment, it is possible to subject tantalum-covered emitter electrode 602 to the anodization process without first masking those surface areas of tantalum-covered emitter electrode 602 which need to be conductive (e.g. sub-pixel and pad areas). That is, because the emitter electrode is completely clad with tantalum, only $Ta_2O_5$ is formed by the anodization process. Unlike $Al_2O_3$, $Ta_2O_5$ can be easily removed from the surface of the emitter electrode. Therefore, in such an embodiment, the entire surface of the tantalum-covered emitter electrode is anodized, and the $Ta_2O_5$ is simply removed from, for example, the sub-pixel and pad areas. Thus, in such an embodiment, the present invention does not require an extensive anodization masking step prior to subjecting the tantalum-covered emitter electrode to the anodization process.

Figure 7A:
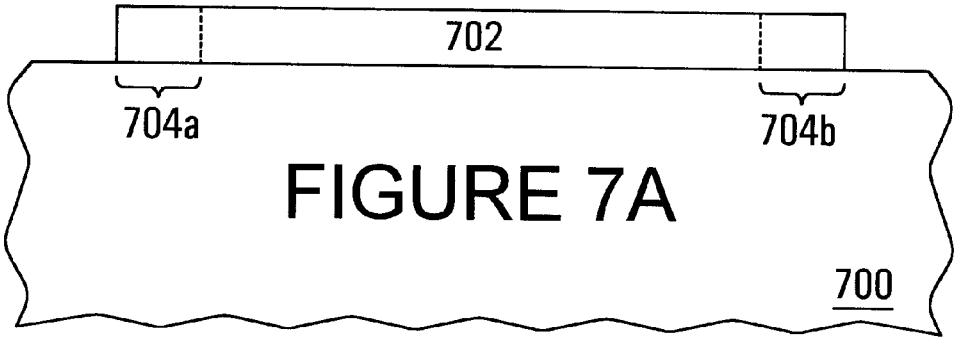
FIG. 7A is a side sectional view of an emitter electrode prior to being subjected to an anodization masking process in accordance with the present claimed invention.

Referring next to FIG. 7A, a side sectional view of a row electrode is shown. In the present embodiment, a substrate 700 has row electrode 702 formed thereon. Row electrode 702 of FIG. 7A also includes pad regions 704*a* and 704*b*. In this embodiment, row electrode 702 is formed of a conductive material such as, for example, aluminum. Although such a row electrode structure is recited in the present embodiment, the present invention is also well suited to an embodiment in which the row electrode structure is comprised of a combination of materials. Such a combination of materials includes, for example, an aluminum row electrode which is partially clad with tantalum, an aluminum electrode which is entirely covered with tantalum, and the like.

Figure 7B:
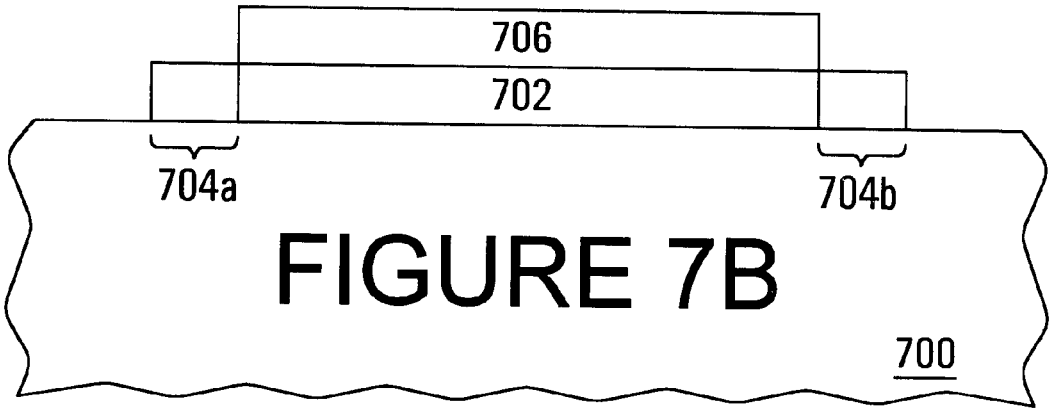
FIG. 7B is a side sectional view of an emitter electrode during a first step of an anodization masking process in accordance with the present claimed invention.

Referring next to FIG. 7B, the present embodiment then deposits a resistor layer 706 over portions of row electrode 702. As shown in the embodiment of FIG. 7B, resistor layer 706 is deposited over row electrode 702 except for pad areas 704*a* and 704*b*. In the present embodiment, resistor layer 706 is formed of silicon carbide (SiC), Cermet, or a dual layer combination. Although the deposition of a resistor layer is recited in the present embodiment, the present invention is also well suited to an embodiment in which a resistor layer is not disposed directly on top of row electrode 702.

Figure 7C:
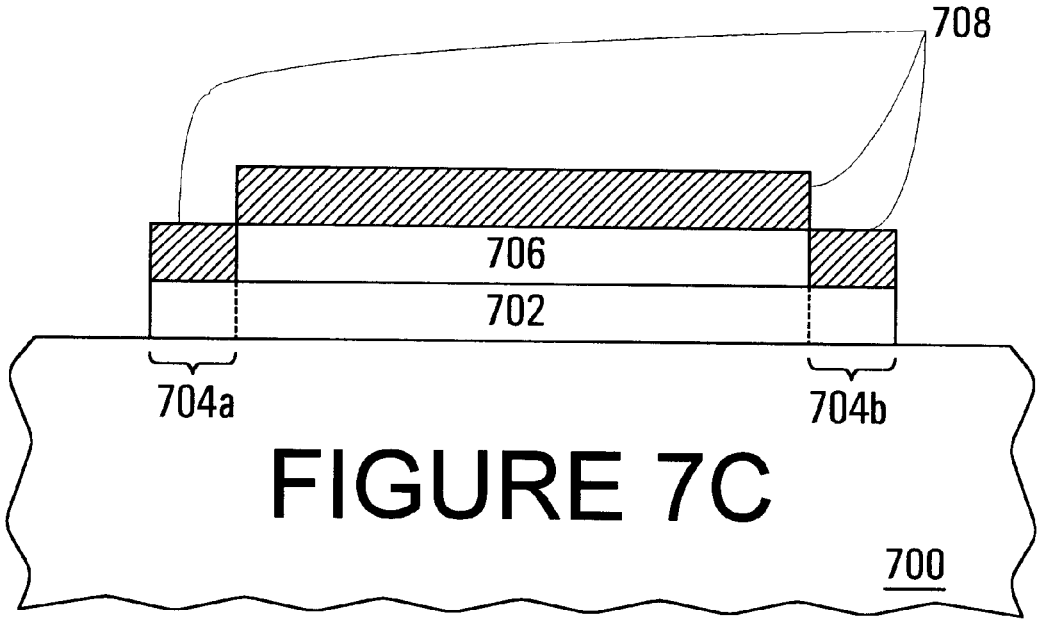
FIG. 7C is a side sectional view of an emitter electrode during a second step of an anodization masking process in accordance with the present claimed invention.

Referring next to FIG. 7C, the present embodiment then deposits an inter-metal dielectric layer 708 over resistor layer 706 and row electrode 702. As shown in FIG. 7C, inter-metal dielectric layer 708 is deposited over the entire surface of row electrode 702, including pad areas 704*a* and 704*b*. Furthermore, in the present embodiment, inter-metal dielectric layer 708 is comprised of a non-conductive material such as, for example, silicon dioxide ($SiO_2$). In the present embodiment, the deposition of inter-metal dielectric layer 708 is accomplished using a standard inter-metal deposition mask which has been modified slightly to provide for deposition of the inter-metal dielectric material onto pad areas 704*a* and 704*b* of row electrode 702. It will be understood, however, that the deposition of the inter-metal dielectric material can be accomplished using various other mask types and masking methods.

Referring still to FIG. 7C, as mentioned above, defects can occur which degrade or render the field emission display structure inoperable. For example, portions of the row electrode may remain exposed when deposition of various layers over the row electrode is not consistent or complete, or when the layers are degraded (e.g. etched or corroded) by subsequent process steps. That is, portions of row electrode 702 may still remain exposed even after deposition of resistor layer 706 and after deposition of inter-metal dielectric layer 708. The inconsistent deposition or degradation of the layers between the row electrode and the column electrode can result in the existence of non-insulative paths which extend from the row electrode to the column electrode. Such a short can render the field emission display device defective and even inoperative. All of the above-described defects result in decreased field emission display device reliability and yield. The present embodiment prevents such defects in the following manner. The present invention subjects resistor and inter-metal dielectric covered row electrode 702 to an anodization process. By subjecting resistor and inter-metal dielectric layer covered row electrode 702 to the anodization process, any exposed portion of row electrode 702 is advantageously anodized. In the present embodiment, the anodization process is performed through inter-metal dielectric layer 708 and resistor layer 706. As a result, any exposed portions of aluminum row electrode 702 will have a layer of $Al_2O_3$ formed thereon. It will be understood that the anodization process could result in the formation of various other coatings such as, for example, $Ta_2O_5$ if the row electrode is clad or covered with tantalum. It will be understood, however, that in the present embodiment, the electrolyte used to anodize the exposed portions of the row electrode must be selected such that it does not attack the resistor or inter-metal dielectric layer.

Figure 8:
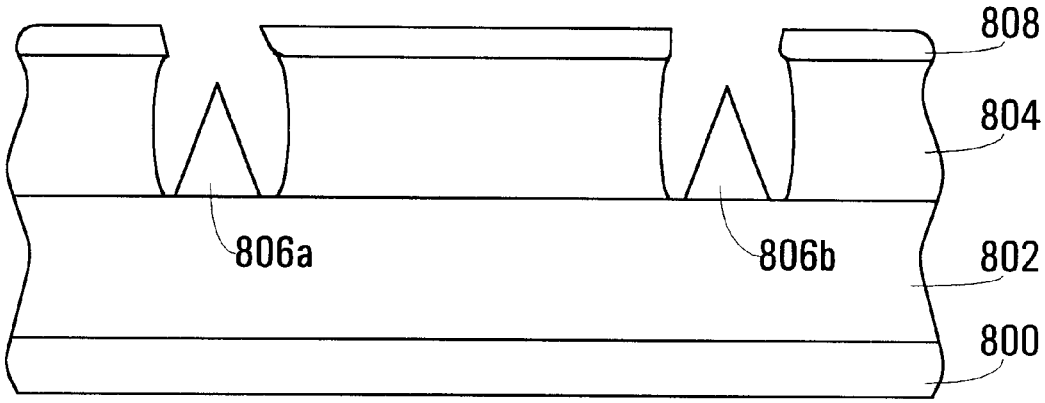
FIG. 8 is a side sectional view illustrating a column electrode disposed beneath a row electrode in accordance with one embodiment of the present claimed invention.

With reference now to FIG. 8, a side sectional view of another embodiment of the present invention is shown. In the present embodiment, the column electrode 800 is disposed underneath the row electrode 808. More specifically, in the present embodiment, a column electrode layer 800 has an overlying resistive layer 802 and an overlying inter-metal dielectric layer 804. Field emitter structures, typically shown as 806*a* and 806*b*, are shown disposed within cavities formed into inter-metal dielectric layer 804. A row electrode 808 is shown disposed above inter-metal dielectric layer 804.

Figure 1A:
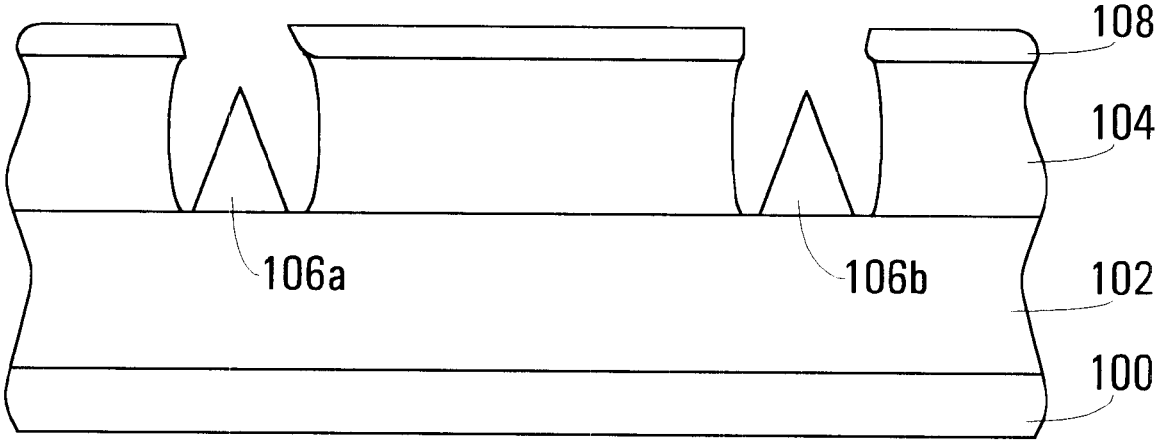
FIGURE 1A (Prior Art)
FIG. 1A is a side sectional view illustrating a pristine conventional field emission display structure.
Figure 1B:
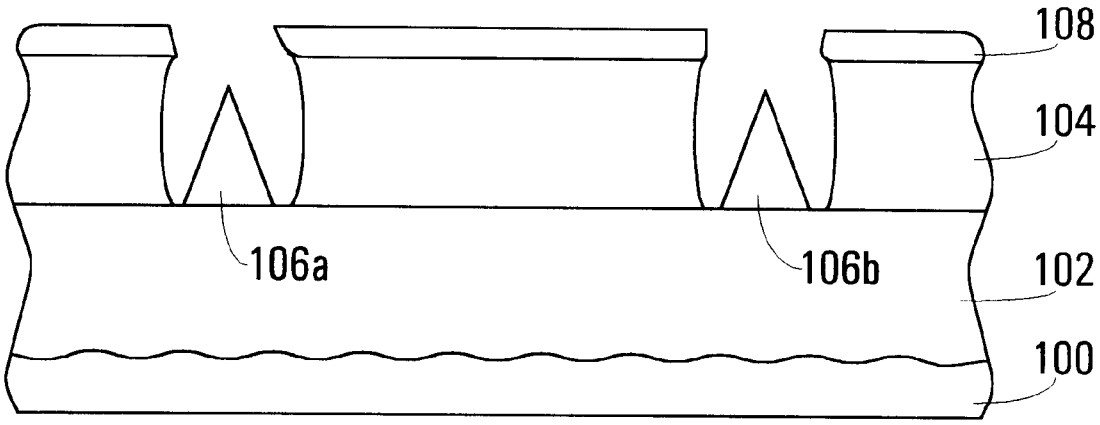
FIGURE 1B (Prior Art)
FIG. 1B is a side sectional view illustrating a defect-containing conventional field emission display structure.
Figure 1C:
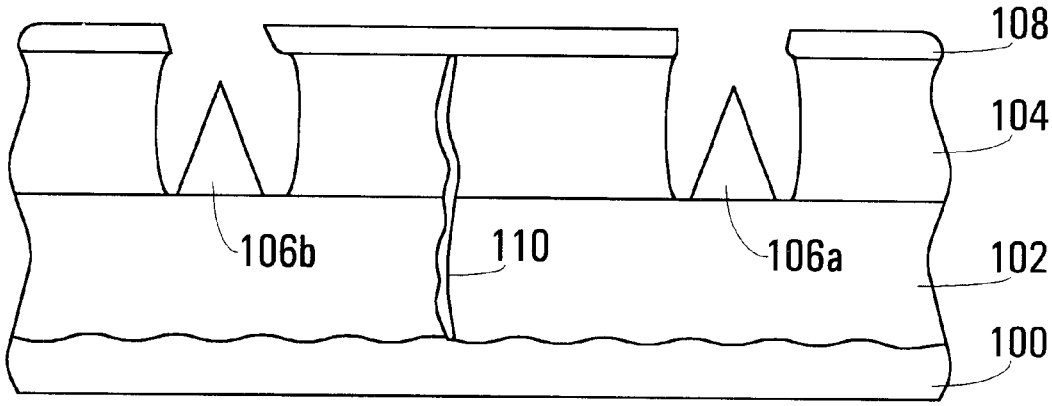
FIGURE 1C (Prior Art)
FIG. 1C is a side sectional view illustrating another defect-containing conventional field emission display structure.
Figure 1D:
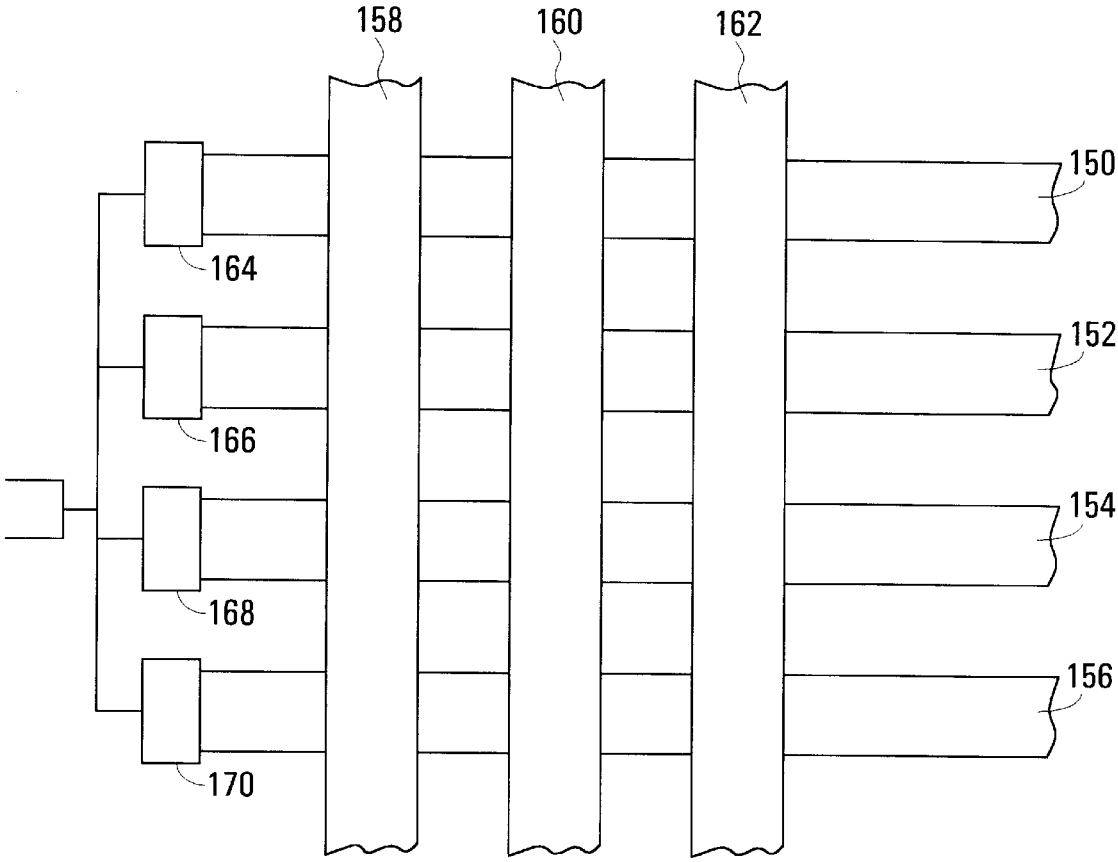
FIGURE 1D (Prior Art)
FIG. 1D is a simplified schematic top plan view of row electrode and column electrode orientation in a conventional field emission display device.
Figure 9:
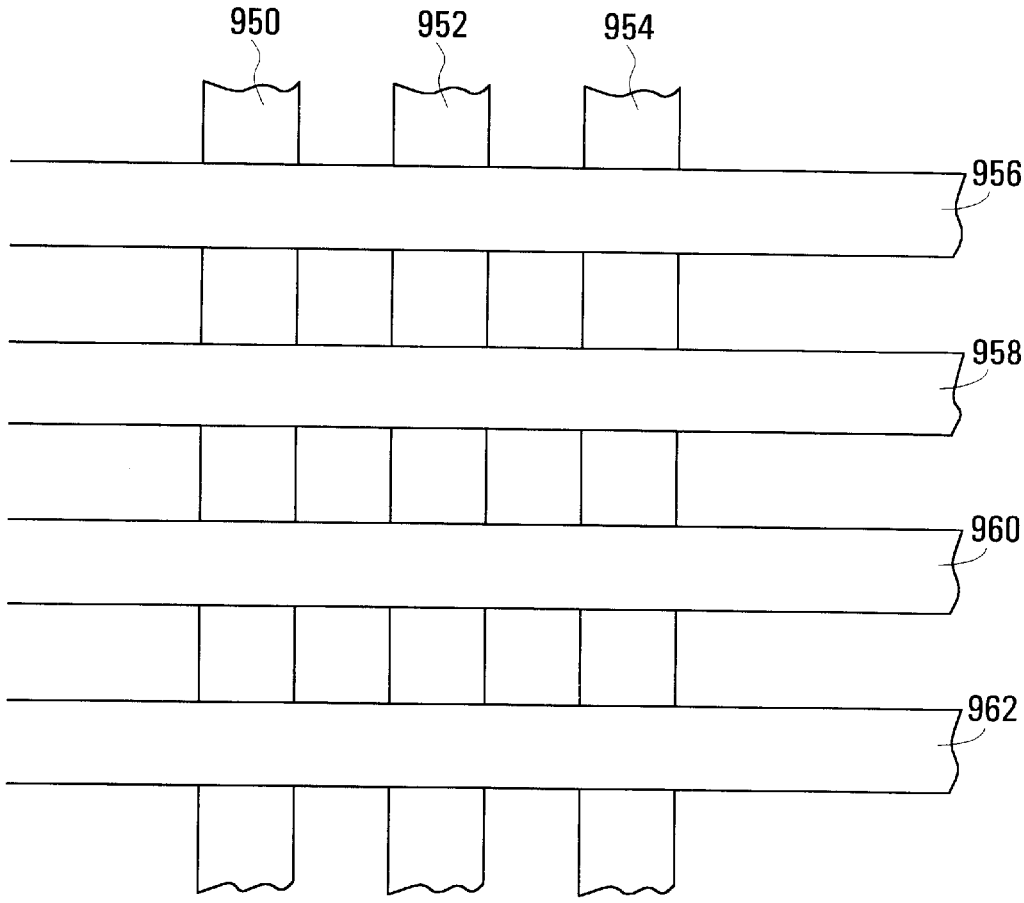
FIG. 9 is a simplified schematic top plan view of row electrode and column electrode orientation wherein the row electrodes are disposed above the column electrodes in accordance with one embodiment of the present claimed invention.

With reference now to FIG. 9, a simplified schematic top plan view of row electrode and column electrode orientation in accordance with the present embodiment is shown. As shown in FIG. 9, in the present embodiment, column electrodes 950, 952, and 954 reside under row electrodes 956, 958, 960, and 962. In operation, Only a few row and column electrodes are shown in Prior Art FIG. 1D for purposes of clarity. It will be understood, however, that in a conventional field emission display device numerous additional row and column electrodes will be present.

Referring still to FIG. 9, during typical operation, one of column electrodes 950, 952, and 954 has a current driven therethrough. A desired one of row electrodes 956, 958, 960, and 962 will be brought to a desired electrical potential with respect to that of the column electrode such that the subpixel located at the intersection of the activated column and row electrode is illuminated. For example, when column electrode 950 has a current driven therethrough and row electrode 956 has a potential applied thereto, the subpixel corresponding to the intersection of column electrode 950 and row electrode 956 will be illuminated.

In the present embodiment, because current is driven through the column electrodes, only one subpixel from each row is activated. Thus, the current is not "shared" by as many subpixels as is the case with conventional field emission displays. That is, in conventional field emission displays, each and every subpixel in a row is activated. Therefore, in a conventional field emission display having X column-by-Y row pixels, the current passed through the row electrode would be shared by 3 X subpixels (i.e. three subpixels for every pixel in a row X pixels wide). In the present embodiment, for a field emission display having X-by-Y pixels, the current passed through the column electrode is only shared by one subpixel (i.e. one subpixel from the row that is activated in a display Y rows tall). In the present example, because only a single subpixel from every row is activated by the corresponding column electrode, no significant decrease or drop in the voltage is present across the length of column electrode 950. As a result, the present embodiment does not produce significant "drop-off" in the brightness of the corresponding illuminated subpixels. Thus, the present embodiment does not suffer from the brightness variations associated with conventional field emission display devices.

As mentioned above in conjunction with Prior Art FIGS. 1B and 1C, during the fabrication of field emission display structures, the aforementioned layers are often subjected to caustic or otherwise deleterious substances. Thus, in the present embodiment where the column electrode 800 underlies the row electrode 808, an untreated column electrode may be susceptible to damage. Specifically, during the fabrication of various overlying layers, column electrode layer 800 of the present embodiment may be subjected to processes which adversely affect the integrity of column electrode 800. Also, other defects can occur which degrade or render the present field emission display structure inoperable. For example, shorting can occur in a field emission display device when the column electrode 800 is not properly insulated from the row electrode 808. The present embodiment prevents such defects from occurring to the column electrode using the methods and processes described above in detail in conjunction with FIG. 2 through FIG. 7C. That is, the column electrode is subjected to the same treatments as were described for the row electrode. More specifically, the column electrode is subjected to, for example, anodization after masking thereof, masking with dielectric material, and the like. Additionally, in the present embodiment the column electrode is comprised of aluminum. The present invention is also well suited however, to use with a column electrode which is comprised of more than one type of conductive material. For example, in another embodiment of the present invention, the column electrode is comprised of aluminum having a top surface clad with tantalum. In yet another embodiment of the present invention, the column electrode is comprised of aluminum having a top surface and side surfaces clad with tantalum.

Figure 10:
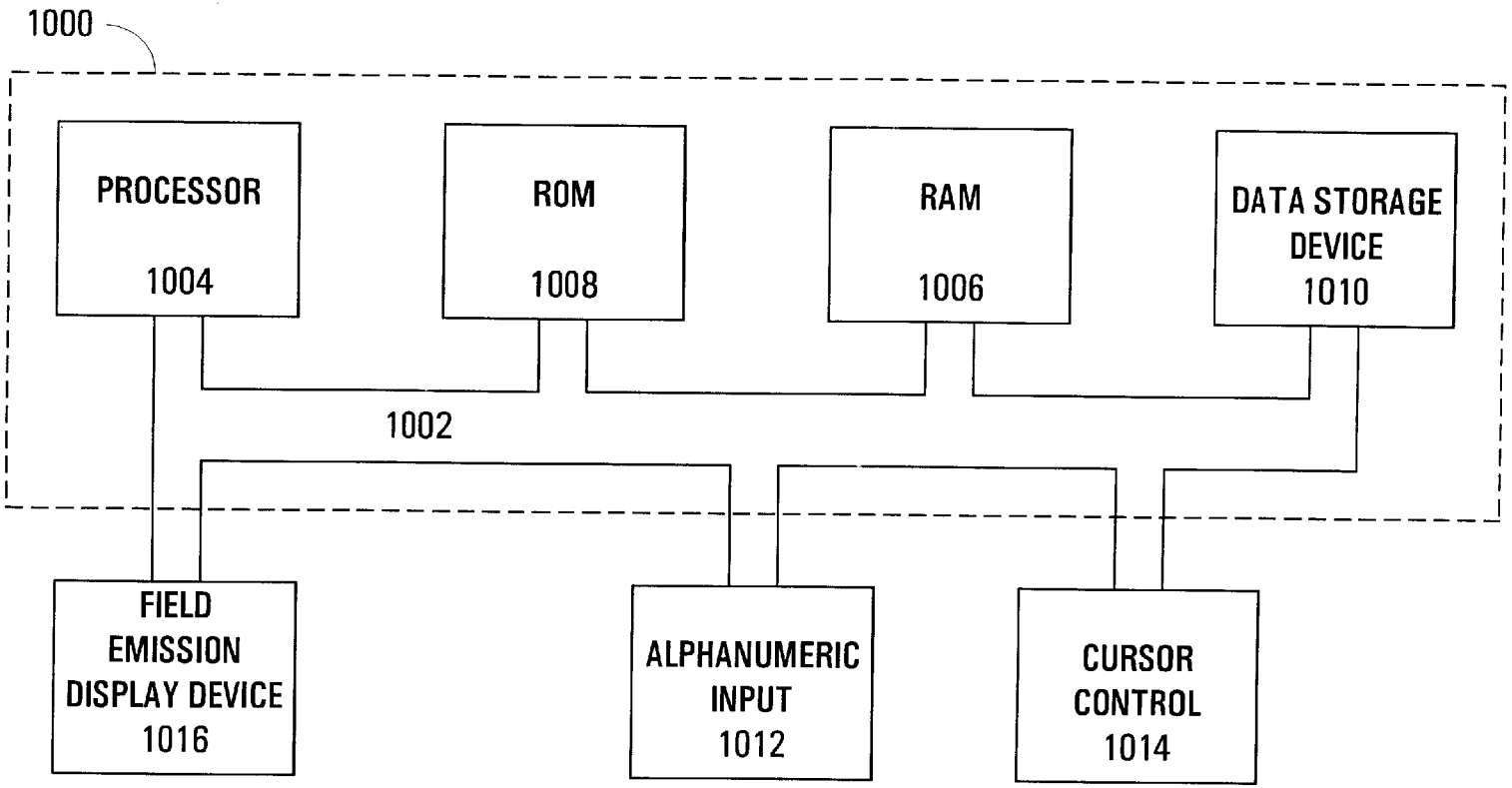
FIG. 10 is a schematic diagram of an exemplary computer system having a field emission display device in accordance with one embodiment of the present invention.

With reference now to FIG. 10, an exemplary computer system 1000 used in accordance with the present embodiment is illustrated. It is appreciated that system 1000 of FIG. 10 is exemplary only and that the present invention can operate within a number of different computer systems including personal computer systems, laptop computer systems, personal digital assistants, telephones (e.g. wireless cellular telephones), in-vehicle systems, general purpose networked computer systems, embedded computer systems, and stand alone computer systems. Furthermore, as will be described below in detail, the components of computer system 1000 reside, for example, in a client computer and/or in the intermediate device of the present system and method. Additionally, computer system 1000 of FIG. 1 is well adapted having computer readable media such as, for example, a floppy disk, a compact disc, and the like coupled thereto. Such computer readable media is not shown coupled to computer system 1000 in FIG. 10 for purposes of clarity.

System 1000 of FIG. 10 includes an address/data bus 1002 for communicating information, and a central processor unit 1004 coupled to bus 1002 for processing information and instructions. Central processor unit 1004 may be, for example, an 80×86-family microprocessor or various other type of processing unit. System 1000 also includes data storage features such as a computer usable volatile memory 1006, e.g. random access memory (RAM), coupled to bus 1002 for storing information and instructions for central processor unit 1004, computer usable non-volatile memory 1008, e.g. read only memory (ROM), coupled to bus 1002 for storing static information and instructions for the central processor unit 1004, and a data storage unit 1010 (e.g., a magnetic or optical disk and disk drive) coupled to bus 1002 for storing information and instructions. System 1000 of the present invention also includes an optional alphanumeric input device 1012 including alphanumeric and function keys is coupled to bus 1002 for communicating information and command selections to central processor unit 1004. System 1000 also optionally includes a cursor control device 1014 coupled to bus 1002 for communicating user input information and command selections to central processor unit 1004. System 1000 of the present embodiment also includes an field emission display device 1016 coupled to bus 1002 for displaying information.

Referring still to FIG. 1, optional cursor control device 1014 allows the computer user to dynamically signal the two dimensional movement of a visible symbol (cursor) on a display screen of display device 1016. Many implementations of cursor control device 1014 are known in the art including a trackball, mouse, touch pad, joystick or special keys on alphanumeric input device 1012 capable of signaling movement of a given direction or manner of displacement. Alternatively, it will be appreciated that a cursor can be directed and/or activated via input from alphanumeric input device 1012 using special keys and key sequence commands. The present invention is also well suited to directing a cursor by other means such as, for example, voice commands.

Thus, the present invention provides a field emission display device wherein display characteristics such as display brightness are not degraded by current drain across the length of the row electrode. The present invention further provides a field emission display structure which is less susceptible to emitter electrode degradation. The present invention also provides a gate electrode structure and gate electrode formation method for use in a field emission display device wherein the gate electrode reduces the occurrence of gate to emitter shorts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order best to explain the principles of the invention and its practical application, thereby to enable others skilled in the art best to utilize the invention and various embodiments with various modifications suited to the particular use contemplated. It is intended that the scope of the invention be defined by the claims appended hereto and their equivalents.

What is claimed is:

1. A field emission display device comprising:

an emitter electrode structure, said emitter electrode structure having first regions thereof which are not protectively anodized, and second regions thereof which are anodized;

an inter-metal dielectric layer disposed above said emitter electrode structure, said inter-metal dielectric layer having a cavity formed therein;

a field emitter structure disposed within said cavity of said inter-metal dielectric layer; and a gate electrode structure disposed above said inter-metal dielectric layer.

2. The field emission display device of claim 1 wherein said emitter electrode structure is comprised of aluminum.

3. The field emission display device of claim 2 wherein said emitter electrode structure has a coating of $Al_xO_y$ formed thereon.

4. The field emission display device of claim 1 wherein said emitter electrode structure is comprised of aluminum having a top surface clad with tantalum.

5. The field emission display device of claim 4 wherein said emitter electrode structure has a $Ta_xO_y$ coating on said top surface and an $Al_xO_y$ coating on side surfaces of said emitter electrode structure at said second regions of said emitter electrode structure.

6. The field emission display device of claim 1 wherein said emitter electrode structure is comprised of aluminum having a top surface and side surfaces clad with tantalum.

7. The field emission display device of claim 6 wherein said emitter electrode structure has a $Ta_xO_y$ coating on said top surface and on said side surfaces of said emitter electrode structure at said second regions of said emitter electrode structure.

8. The field emission display device of claim 1 wherein said first regions of said emitter electrode structure include pad areas of said emitter electrode structure.

9. The field emission display device of claim 1 wherein said first regions of said emitter electrode structure include sub-pixel areas of said emitter electrode structure.

10. The field emission display device of claim 1 further comprising:

a resistive layer disposed overlying said emitter electrode structure.

11. The field emission display device of claim 1 wherein said emitter electrode structure is a row electrode and said gate electrode is a column electrode.

12. The field emission display device of claim 1 wherein said emitter electrode structure is a row electrode and said gate electrode is a column electrode, and wherein said row electrode is electrically coupled to said column electrode.

13. In a field emission display device, a method for protectively processing an emitter electrode disposed beneath a gate electrode, said method comprising the steps of:

a) depositing a resistor layer over portions of said emitter electrode, b) depositing an inter-metal dielectric layer over said emitter electrode, said inter-metal dielectric layer deposited over portions of said resistor layer and over pad areas of said emitter electrode, said inter-metal dielectric layer adapted to have said gate electrode subsequently disposed thereon; and c) subjecting said emitter electrode, having said resistor layer and said inter-metal dielectric layer disposed thereover, to an anodization process such exposed regions of said emitter electrode are anodized.

14. The method for protectively processing an emitter electrode in a field emission display device as recited in claim 13 wherein said emitter electrode is comprised of aluminum.

15. The method for protectively processing an emitter electrode in a field emission display device as recited in claim 14 wherein said anodization process of step c) forms an $Al_xO_y$ coating on said exposed regions of said emitter electrode.

16. The method for protectively processing an emitter electrode in a field emission display device as recited in claim 13 wherein said emitter electrode is comprised of aluminum having a top surface clad with tantalum.

17. The method for protectively processing an emitter electrode in a field emission display device as recited in claim 16 wherein said anodization process of step c) forms a $Ta_xO_y$ coating on said top surface of said emitter electrode clad with tantalum at said exposed regions of said emitter electrode and an $Al_xO_y$ coating on side surfaces of said emitter electrode at said exposed regions of said emitter electrode.

18. The method for protectively processing an emitter electrode in a field emission display device as recited in claim 13 wherein said emitter electrode is comprised of aluminum having a top surface and side surfaces clad with tantalum.

19. The method for protectively processing an emitter electrode in a field emission display device as recited in claim 18 wherein said anodization process of step c) forms a $Ta_xO_y$ coating on said top surface and said side surfaces of said emitter electrode clad with tantalum at said exposed regions of said emitter electrode.

20. In a field emission display device, a method for forming an anodized column electrode which underlies a row electrode, said method comprising the steps of:

a) masking said column electrode such that first regions of said column electrode are masked and such that second regions of said column electrode are not masked; and b) subjecting said column electrode to an anodization process such that said first regions of said column electrode are not anodized and such that said second regions of said column electrode are anodized.

21. The method for forming an anodized column electrode in a field emission display device as recited in claim 20 wherein said column electrode is comprised of aluminum.

22. The method for forming an anodized column electrode in a field emission display device as recited in claim 21 wherein said anodization process of step b) forms an $Al_xO_y$ coating on said second regions of said column electrode.

23. The method for forming an anodized column electrode in a field emission display device as recited in claim 20 wherein said column electrode is comprised of aluminum having a top surface clad with tantalum.

24. The method for forming an anodized column electrode in a field emission display device as recited in claim 23 wherein said anodization process of step b) forms a $Ta_xO_y$ coating on said top surface of said column electrode clad with tantalum at said second regions of said column electrode and an $Al_xO_y$ coating on side surfaces of said column electrode at said second regions of said column electrode.

25. The method for forming an anodized column electrode in a field emission display device as recited in claim 20 wherein said column electrode is comprised of aluminum having a top surface and side surfaces clad with tantalum.

26. The method for forming an anodized column electrode in a field emission display device as recited in claim 25 wherein said anodization process of step b) forms a $Ta_xO_y$ coating on said top surface and said side surfaces of said column electrode clad with tantalum at said second regions of said column electrode.

27. The method for forming an anodized column electrode in a field emission display device as recited in claim 20 wherein said first regions of said column electrode include pad areas of said column electrode.

28. The method for forming an anodized column electrode in a field emission display device as recited in claim 20 wherein said first regions of said column electrode include sub-pixel areas of said column electrode.

29. In a field emission display device in which a row electrode is disposed above a column electrode, a method for forming an anodized column electrode comprising the steps of:

a) subjecting said column electrode to an anodization process such that a protective anodization coating is formed on said column electrode; and b) removing said protective anodization coating from first regions of said column electrode and leaving said protective anodization coating on said second regions of said column electrode.

30. The method for forming an anodized column electrode in a field emission display device as recited in claim 29 wherein said column electrode is comprised of aluminum.

31. The method for forming an anodized column electrode in a field emission display device as recited in claim 30 wherein said anodization process of step a) forms an $Al_xO_y$ coating on said column electrode.

32. The method for forming an anodized column electrode in a field emission display device as recited in claim 29 wherein said column electrode is comprised of aluminum having a top surface clad with tantalum.

33. The method for forming an anodized column electrode in a field emission display device as recited in claim 32 wherein said anodization process of step a) forms a $Ta_xO_y$ coating on said top surface of said column electrode and an $Al_xO_y$ coating on side surfaces of said column electrode.

34. The method for forming an anodized column electrode in a field emission display device as recited in claim 29 wherein said column electrode is comprised of aluminum having a top surface and side surfaces clad with tantalum.

35. The method for forming an anodized column electrode in a field emission display device as recited in claim 34 wherein said anodization process of step a) forms a $Ta_xO_y$ coating on said top surface and said side surfaces of said column electrode.

36. The method for forming an anodized column electrode in a field emission display device as recited in claim 29 wherein said first regions of said column electrode include pad areas of said column electrode.

37. The method for forming an anodized column electrode in a field emission display device as recited in claim 29 wherein said first regions of said column electrode include sub-pixel areas of said column electrode.

* * * * *